United States Patent [19]

Chapman

[11] 4,392,649

[45] Jul. 12, 1983

[54] HAND, WRIST AND FOREARM EXERCISING DEVICE

[76] Inventor: Dan Chapman, 1107 E. Teresa, Sapulpa, Okla. 74066

[21] Appl. No.: 276,030

[22] Filed: Jun. 22, 1981

[51] Int. Cl.[3] ..... A63B 21/00

[52] U.S. Cl. ..... 272/67; 272/132; 188/77 R

[58] Field of Search ..... 272/132, 67, 68, 900, 272/135, 140, 136; 188/77 R, 77 W

[56] References Cited

U.S. PATENT DOCUMENTS

| | | | |
|---|---|---|---|
| 1,195,959 | 8/1916 | Bardsley | 188/77 R |
| 1,604,333 | 10/1926 | Anderson | 272/67 |
| 2,530,921 | 11/1950 | Tougas | 272/132 |
| 3,442,132 | 5/1969 | DeMare | 73/379 |
| 3,614,097 | 10/1971 | Blickman | 272/63 |
| 3,649,008 | 3/1972 | Zinken | 272/67 |
| 3,785,644 | 1/1974 | Bradley | 73/379 |
| 4,153,244 | 5/1979 | Tauber | 272/117 |
| 4,169,591 | 5/1928 | Douglas | 272/73 |
| 4,193,593 | 3/1980 | Wilson | 272/67 |
| 4,344,615 | 8/1982 | Carlson | 272/67 |

*Primary Examiner*—Richard J. Johnson

*Attorney, Agent, or Firm*—Head, Johnson & Stevenson

[57] ABSTRACT

A hand, wrist and forearm exerciser device comprising a roller assembly adapted to be grasped by either one or both hands of the user for rolling or twisting of the assembly about its own longitudinal axis, clamping members secured to the opposite ends of the roller assembly for securing the device to a suitable support structure, such as a bench press apparatus, and an adjustable tensioning assembly operably connected with the roller assembly for applying a preselected resistance to the twisting of the roller to provide an effective and efficient hand, wrist and forearm exercising operation.

3 Claims, 4 Drawing Figures

HAND, WRIST AND FOREARM EXERCISING DEVICE

BACKGROUND OF THE INVENTION

1. Field of the Invention

This invention relates to improvements in exercising devices and more particularly, but not by way of limitation, to a hand, wrist and forearm exercising device.

2. Description of the Prior Art

There is a widespread interest today in maintaining exercising programs, and the like, for improvement of personal health and well being, and along with this growing participation in sports, jogging, aerobics, and the like, there is an accompanying consideration and activity in body building achievements of many types. For example, bench pressing is becoming a more and more popular pastime, along with substantially any desirable exercising for particular body members, such as the wrists, hand and forearm. As a result there are many exercising devices designed for particular emphasis in the development of particular parts of the body, such as the DeMare U.S. Pat. No. 3,442,132, issued May 6, 1969, and entitled "Electric Myodynamometer"; the Blickman U.S. Pat. No. 3,614,097, issued Oct. 19, 1971, and entitled "Weight Lifting Exercising Apparatus"; the Zinken et al U.S. Pat. No. 3,649,008, issued Mar. 14, 1972, and entitled "Hand and Wrist Exerciser Device"; the Bradley et al U.S. Pat. No. 3,785,644, issued Jan. 15, 1974, and entitled "Pull Type Exercising Device Having With Frictional Resistance to Pulling"; the Tauber, Jr. U.S. Pat. No. 4,153,244, issued May 8, 1979, and entitled "Gymnastic set for Wheelchair Patients"; and the Wilson U.S. Pat. No. 4,193,593, issued Mar. 18, 1980, and entitled "Arm and Wrist Exerciser". The DeMare myodynamometer is a device for determining muscular energy expended in doing work over a period of time; and the Blickman exerciser is for toning up various parts of the human body by the use of pulley weights, chinning bars, parallel horizontal bars, rowing seat, hand strengthening roll and foot exerciser, and is a rather all-inclusive apparatus. Bradley et al is a physical exercising apparatus including a rotatable shaft having reels at the opposite ends thereof and connected to a base by lines wound on the reels. When the shaft or bar assembly is elevated the shaft will resist any force required to rotate the shaft. The Tauber apparatus is essentially a self-contained gynmastic apparatus comprising many exercising elements for exercising various parts of the body and is particularly designed for use by wheelchair patients. The Zinken et al patent relates to a hand and wrist exerciser comprising a pair of oppositely disposed handles mounted for rotation about a common shaft, each handle having a rotatable knob means at the outer end thereof for wrist exercising, and the Wilson arm and wrist exerciser comprises inner and outer tubes telescopically arranged for alternate extended and collapsed positions. An elongated resilient element extends through the inner tube and is secured to the opposite ends thereof for resisting movement of the tubes from the collapsed position. The tubes are also relatively rotatable for exercising of the wrists. The devices have certain disadvantages, however, in that they are of a relatively complex and expensive construction, and the assembly or setting up of the exercising equipment is somewhat difficult, thus resulting in a more permanent nature for the setting of the equipment. In addition, most of these devices are not readily adaptable for use in conjunction with other exercising apparatus that is normally in widespread use today.

SUMMARY OF THE INVENTION

The present invention contemplates a novel hand, wrist and forearm exercising device which is particularly designed and constructed for overcoming the foregoing disadvantages. The novel exercising device comprises a roller element adapted for support by the usual or commonly used barbell bench which is normally found in the many exercising establishments available today. A tension means is mounted at one side or end of the roller means for adjusting the resistance to the rolling or twisting of the roller, and the hands, wrists and forearms may be efficiently exercised by grasping the outer periphery of the roller element and twisting thereof in either a forward or reverse direction against the resistance as established by the tensioning means. The novel exercising apparatus is simple and efficient in operation and economical and durable in operation.

DETAILED DESCRIPTION OF THE PREFERRED EMBODIMENT

Figure 1:
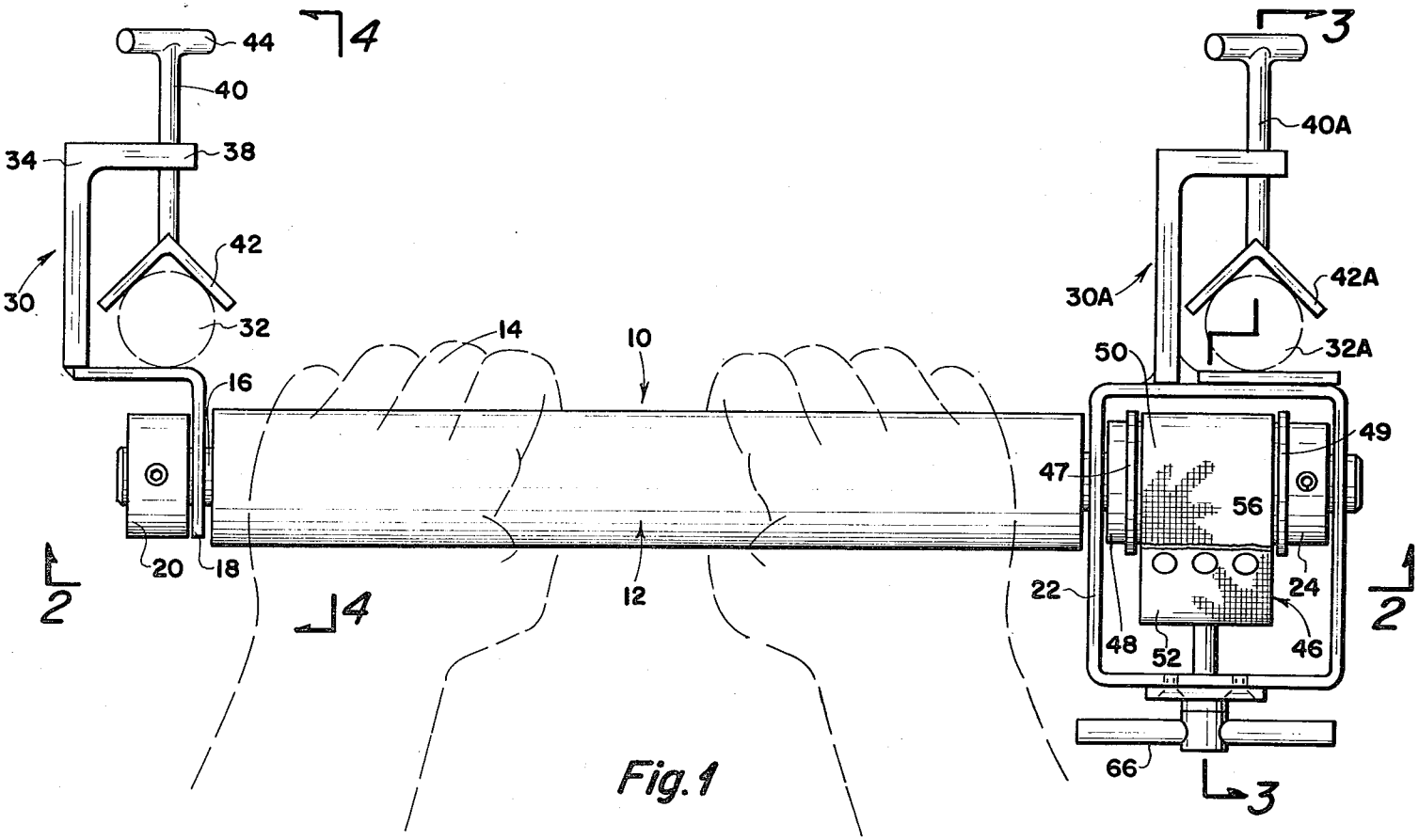
FIG. 1 is a front elevational view of a hand, wrist and forearm exercising device embodying the invention, with the hands of a user of the apparatus shown in broken lines for purposes of illustration.
Figure 2:
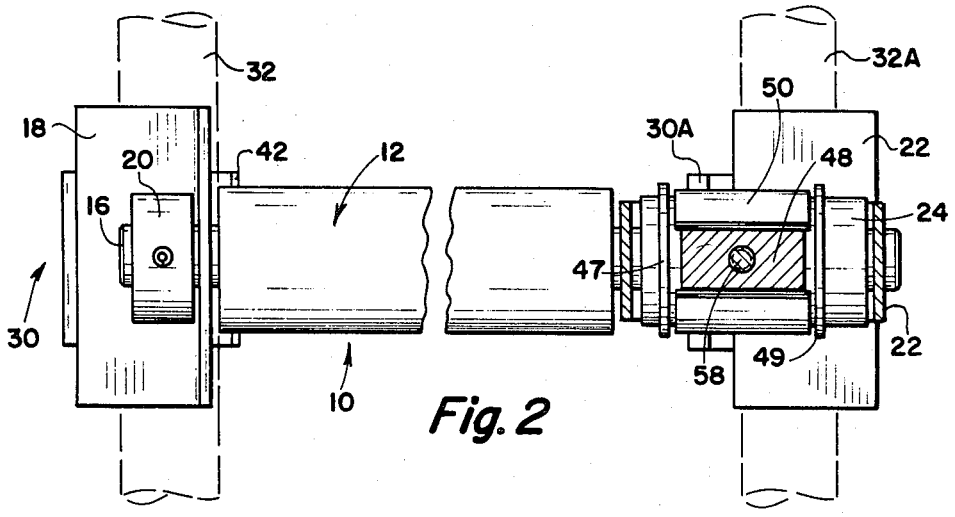
FIG. 2 is a view taken on line 2—2 of FIG. 1, with portions shown in broken lines for purposes of illustration.

Referring to the drawings in detail, reference character 10 generally indicates a hand, wrist and forearm exercising device comprising a roller assembly 12 adapted for rotation about its own longitudinal axis upon gripping of the outer periphery thereof by the hand or hands 14 of the user of the apparatus 10 and twisting thereof. The roller assembly 12 comprises a central shaft 16 having one end extending through a suitable L-shaped bracket member 18 and having a retaining collar means 20 secured outboard of the shaft 16 therefrom. The opposite end of the shaft 16 extends through an open frame means 22 of a substantially rectangular planar configuration, as particularly shown in FIG. 1, and is provided with a collar means generally similar to the collar means 24 for a purpose as will be hereinafter set forth. An intermediate tubular member 26 is concentrically arranged around the outer periphery of the shaft 16 and is secured therein in any suitable manner for simultaneous rotation therebetween, and a resilient sleeve or covering 28 is disposed around the outer periphery of the intermediate tube 26 and interposed between the bracket 18 and frame 22 for providing a gripping section for the hands 14.

A suitable clamping means generally indicated at 30 is welded or otherwise rigidly secured to the bracket 18 for removably clamping one end of the assembly 10 to a suitable support element 32, which may be one of the elements of the back of the usual bench press apparatus (not shown). The clamping means 30 as shown herein comprises a substantially L-shaped bracket member 34 having one end 36 rigidly secured to the outermost end of the bracket 18, as shown in FIG. 1, and having the other end 38 extending substantially parallel to and spaced from the bracket 18. An aperture (not shown) is provided in the end member 38 for slidably receiving a rod means 40 therethrough, and the inner periphery of the aperture and outer periphery of the rod 40 may be threaded, if desired, for reciprocation of the rod 40 in directions toward and away from the bracket 18. An inverted V-shaped clamping member 42 is secured at the inner end of the rod 40 for selective engagement with the support member 32, and a suitable handle means 44 is provided at the outer end of the rod means 40 for facilitating rotation thereof for providing alternate positions of engagement and disengagement of the clamp member 42 with the support member 32.

A substantially identical clamping apparatus 30A is welded or otherwise rigidly secured to the frame 22, and is provided with a reciprocal rod means 40A and clamp member 42A substantially identical with the rod 40 and clamp 42 for similar selective engagement with a support member 32A, which may be another element of the back of the bench press apparatus as hereinafter set forth.

Figure 3:
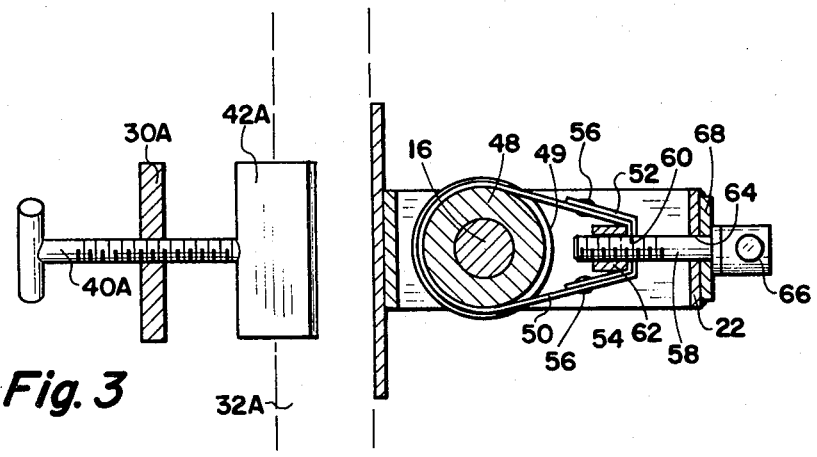
FIG. 3 is a view taken on line 3—3 of FIG. 1 with portions of a suitable support apparatus shown in broken lines.
Figure 4:
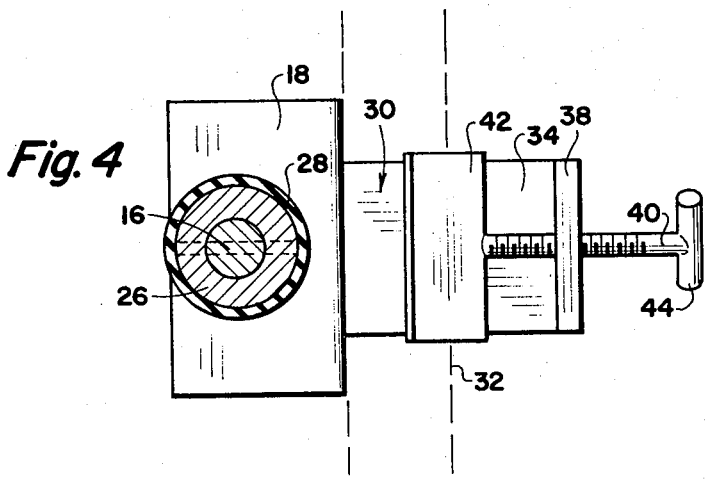
FIG. 4 is a view taken on line 4—4 of FIG. 1, with portions of a suitable support apparatus illustrated in broken lines.

A tensioning apparatus generally indicated at 46 is disposed within the frame means 22 and is operably connected with the shaft 16 for providing a preselected tensioning or resistance to the rotation of the shaft, as will be hereinafter set forth. The apparatus 46 as shown herein comprises a sleeve member 48 disposed around the portion of the shaft 16 extending through the interior of the frame 22 and secured thereto in any suitable manner (not shown). A friction belt means 50 is wrapped around a portion of the outer periphery of the sleeve 48 and a pair of flanges 47 and 49 are disposed around the outer periphery of the sleeve 48 for retaining the belt 50 in position thereon. The ends 52 and 54 of the belt 50 are spaced from the sleeve 48, as particularly shown in FIG. 3 and are secured in an overlapping position in any suitable manner such as by rivets 56. A threaded shank or rod member 58 extends through aligned apertures 60 provided in the ends 52 and 54 and a nut or stop means 62 is secured to the inner end of the rod 58, inboard of the overlapped ends 52 and 54. The outer end of the rod 58 extends through an aperture 64 provided in the frame means 22 and is rotatable with respect thereto. A handle means 66 is suitably secured to the outer end of the rod 58 and an annular bushing plate 68 is preferably interposed between the frame means 22 and the handle means 66 for facilitating rotation of the rod 58 as will be hereinafter set forth.

In use, the exercising apparatus 10 may be quickly and easily installed on a suitable support structure, such as the elements 32 and 32A of the back of a bench press apparatus (not shown) by sliding the clamping assemblies 30 and 30A over the support member 32 and 32A. This is particularly simple since it is preferable that the clamping assemblies 30 and 30A be mounted in a common direction as is clearly shown in FIG. 1. When the clamping assemblies 30 and 30A are in position on the elements 32 and 32A, the clamp members 42 and 42A may be securely clamped against the respective elements 32 and 32A by the normal manipulation of the rotatable rods 40 and 40A, as is well known.

The roller assembly 12 may then be grasped by either one or both hands 14 of the user of the apparatus 10, and the roller may be rotated or twisted about its own longitudinal axis in either forward or reverse directions, as desired, for exercising of the hands, wrists and forearms. In order to adjust the tension on the roller 12 in order to selectively adjust the resistance to the twisting action, the handle means 66 may be rotated in the proper direction for either pulling the stop member 62 in a direction toward the handle means 66 moving the stop member 62 in a direction away from the handle means 66. It will be readily apparent that the frictional engagement between the overlapped ends 52 and 54 and the stop member 62 will preclude rotation of the stop member simultaneously with the rotation of the rod member 58, and as the rod is rotated by the handle means 66, the stop member 62 will move longitudinally along the threaded portion of the rod. Movement of the stop member in one direction will increase the tension of the belt means 50 against the outer periphery of the sleeve 48, whereas movement of the stop member in an opposite direction will reduce the tension of the belts 50 against the outer periphery of the sleeve 48.

When the exercising apparatus 10 is no longer in use, or when it is desired to store the device, the clamping assemblies 30 and 30A may be quickly and easily released from the clamping engagement with the support elements 32 and 32A whereby the device 10 may be removed from the bench press, or the like. The lightweight construction and overall relatively small size of the device 10 facilitates the storage thereof until such time as the exercising device is again required for utilization.

From the foregoing it will be apparent that the present invention provides a novel hand, wrist and forearm exercising device which may be quickly and easily installed on a suitable support means and which comprises a roller member adapted to be grasped by the hands of the user for twisting against a preselected tension or resistance, thereby providing exercising for conditions of the hands, wrist and forearms of the user. A tensioning device is provided for the roller which may be easily adjusted for providing substantially any desired resistance to the twisting of the roller, thus providing an efficient exercising apparatus.

Whereas the present invention has been described in particular relation to the drawings attached hereto, it should be understood that other and further modifications, apart from those shown or suggested herein may be made within the spirit and scope of this invention.

What is claimed is:

1. A hand, wrist and forearm exercising apparatus adapted to be removably mounted on a support structure and comprising elongated continuous roller means to be grasped about the outer periphery by the hands of the user for twisting thereof about its own longitudinal axis, clamping means secured to the opposite ends of the roller means for suspending the roller means therebetween and securing said roller means to said support structure, and tensioning means operably connected with the roller means and disposed in the proximity of one end thereof, said tensioning means comprising a sleeve means secured in the proximity of one end of the roller means, friction belt means disposed around at least a portion of the outer periphery of the sleeve means, and means operably connected directly to the friction belt means for adjusting the tension of the belt for providing substantially any desired resistance to the twisting motion for an effective exercising of the hands, and wrist and forearm of the user.

2. A hand, wrist and forearm exercising apparatus as set forth in claim 1 wherein the tensioning means further comprises rotatable adjusting means connected with the friction belt means and rotatable in one direction for increasing the friction of the belt means against the outer periphery of the sleeve means and in an opposite direction for decreasing the friction of the belt means against the outer periphery of the sleeve means.

3. A hand, wrist and forearm exercising apparatus as set forth in claim 1 wherein the roller means comprises a centrally disposed longitudinally extending rotatable shaft member, an intermediate sleeve means secured around the outer periphery of at least a portion of the shaft member, and a yieldable sleeve member disposed around the outer periphery of the intermediate sleeve means and adapted for engagement by the hands of the user.

* * * * *